US005384987A

United States Patent [19]

Wiand

[11] Patent Number: 5,384,987

[45] Date of Patent: Jan. 31, 1995

[54] METHOD AND APPARATUS FOR COMPENSATING FOR LENS BLANK MATERIAL DIFFERENTIAL IN OPHTHALMIC BEVEL EDGING PROCESS

[76] Inventor: Ronald C. Wiand, 1494 Heatherwood Dr., Troy, Mich. 48098

[21] Appl. No.: 960,956

[22] Filed: Oct. 14, 1992

[51] Int. Cl.[6] ..... B24B 1/00

[52] U.S. Cl. ..... 451/41; 451/177

[58] Field of Search ..... 51/100 R, 101 R, 101 LG, 51/104, 105 LG, 106 LG, 284 E

[56] References Cited

U.S. PATENT DOCUMENTS

| | | | |
|---|---|---|---|
| 4,394,099 | 7/1983 | Santinelli | 51/101 LG |
| 4,423,569 | 1/1984 | Stern et al. | 51/101 LG |
| 4,512,108 | 4/1985 | Kobayashi | 51/101 LG |
| 4,667,444 | 5/1987 | Langlois et al. | 51/101 LG |
| 5,027,561 | 7/1991 | Brule et al. | 51/165.77 |

*Primary Examiner*—Maurina T. Rachuba

*Attorney, Agent, or Firm*—Harness, Dickey & Pierce

[57] ABSTRACT

An apparatus and a method for accommodating for differential in an ophthalmic lens grinding operation utilizing bevel edger machines. Such machines typically include a lens former assembly which has a former member upon which a particular frame shaped template rides to form the proper shape of the lens. The method includes the steps of adapting the former lens assembly of the bevel edger machine, externally of the differential settings of the machine, to provide a first profile for increasing the differential profile of the former member for a first lens-like material and allowing for providing a second differential for the former member which provides a proper differential for a second lens blank material. This may be accomplished in providing an adapter which is interposed between the former wheel and the lens template or a stepped former member. This provides for a new differential external to the internal adjustments of the machine. Additionally, there is provided a method for dry forming a polycarbonate lens whereby polishing of the bevel edge of the lens polycarbonate is accomplished which includes the steps of first dry grinding the rough polycarbonate lens and thereafter dry bevel edging a first periphery on the lens and thereafter wet finishing the peripheral surface around the lens whereby a polished polycarbonate lens edge is the result.

16 Claims, 2 Drawing Sheets

METHOD AND APPARATUS FOR COMPENSATING FOR LENS BLANK MATERIAL DIFFERENTIAL IN OPHTHALMIC BEVEL EDGING PROCESS

BACKGROUND OF THE INVENTION

The present invention relates to modifications of ophthalmic lens grinding machines for providing for differential adjustment external to the internal machine settings. More specifically, the present invention relates to a method and apparatus for adjusting the forming members of a lens bevel edger machine for providing a plurality of differentials such that various lens blank materials can be accommodated on a single bevel edger machine.

In the lens grinding industry a great number of ophthalmic labs have sprung up with the advent of modern bevel edger machines. These machines are capable of taking a lens blank and grinding a final shape of a lens for fitting of the lens in a particular frame. Thus, a lens blank of the proper prescription is rough cut to the rough shape of the frame and thereafter a bevel edge is ground on the lens such that the lens will properly fit in the glasses frame. Such procedures are known in the art and explained in the owner's manuals of AIT and WECO bevel edger machines which are incorporated herein by reference thereto.

In modern eyeglasses, lens blank materials are commonly CR 39 plastic, polycarbonate or glass. Irrespective of what type of material is used a differential is required between the rough cut edging and the final bevel edging operation such that all the chips, cracks and the like formed at the edge of the rough cut lens may be removed during the final bevel edging operation of the machine. Thus, the term "differential" in the ophthalmic industry means the difference in dimension between the rough cut edge and the final bevel edge. For instance, typically in polycarbonate or CR 39 plastic lenses the rough cut dimension is from about 0.5 to 1 millimeter larger in radial distance than in the final finished size lens. However, with materials that chip readily, such as commonly available glass, the differential must be larger, on the order of from about 1½ millimeters to 2 millimeters to provide the necessary amount of material for removal during finish beveling.

Typically, a bevel edging machine is preset internally through a tedious series of adjustments to provide the required differential for a particular set-up, i.e. either glass or plastic. This typically requires lens grinding labs either to have two separate machines or to send out work which can not be done on the single existing machine commonly found in ophthalmic labs of today.

The purchase of a second machine would allow more flexibility to a small lens grinding lab. A second machine could be set for a different lens blank material, thus, allowing a small lab to cut its own lenses irrespective of the material of the lens. However, the cost of a bevel edger machine makes this remedy extremely cost prohibitive particularly in light of the small volume of business done in certain types of materials.

Thus, there remains a need in the art to provide a system for bevel edging of all common types of lens blank materials, including CR 39 plastic, polycarbonate and glass, in a single bevel edger machine.

Additionally, polycarbonate lenses require special dry grinding of the lens because of its thermoplastic nature. Lens grinding machines typically operate with coolant flow during grinding and thus are not set up for polycarbonate grinding. Also, polycarbonate lenses typically require special polishing of the final bevel edge external to the bevel edger machine. Therefore, it is also desirable to provide a method for bevel edging of polycarbonate lenses which require special treatment as opposed to the CR 39 plastics or other lens blank materials, while using a single machine.

SUMMARY OF THE INVENTION

In accordance with the present invention there is provided an apparatus and a method for accommodating for differential in an ophthalmic lens grinding operation utilizing bevel edger machines. Such machines typically include a lens former assembly which has a former member upon which a particular frame shaped template rides to form the proper shape of the lens. The method includes the steps of adapting the former lens assembly of the bevel edger machine, externally of the differential settings of the machine, to provide a first profile for increasing the differential profile of the former member for a first lens-like material and allowing for providing a second differential for the former member which provides a proper differential for a second lens blank material. This may be accomplished in providing an adapter which is interposed between the former wheel and the lens template or a stepped former member. This provides for a new differential external to the internal adjustments of the machine. Additionally, there is provided a method for dry forming a polycarbonate lens whereby polishing of the bevel edge of the lens polycarbonate is accomplished which includes the steps of first dry grinding the rough polycarbonate lens and thereafter dry bevel edging a first periphery on the lens and thereafter wet finishing the peripheral surface around the lens whereby a polished polycarbonate lens edge is the result.

It is therefore an object of the present invention to provide an adaptation external to the internal adjustments of the bevel edger machine for compensating for separate differentials between various lens blank materials whereby a single bevel edger machine can be used to accomplish bevel edging of any of a variety of lens blank materials.

It is still further an object of the present invention to provide a method for forming of polycarbonate lenses whereby a finished polycarbonate lens may be provided wherein the beveled edge is polished without an external polishing device.

Further objects and advantages of the present invention will be realized by review of the appended specification including the description of the drawings, the description of the preferred embodiments and the claims appended hereto.

DESCRIPTION OF THE PREFERRED EMBODIMENTS

Figure 1:
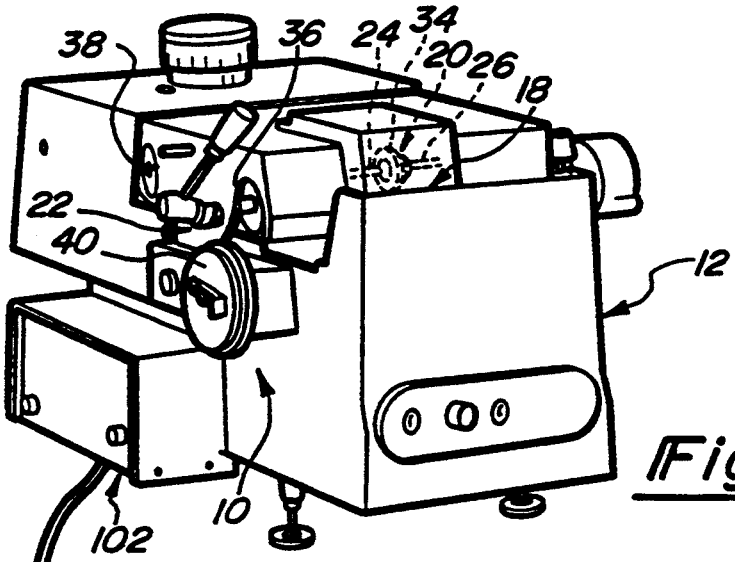
FIG. 1 shows a typical bevel edger machine.

Referring now to the drawings, there is provided a method and apparatus generally indicated at 10 for accommodating for lens blank material differential in an ophthalmic lens edging operation which utilizes a bevel edger machine generally indicated at 12. Referring to FIG. 1 there is shown a typical lens bevel edger machine utilized in ophthalmic labs today. Such bevel edgers include a rough grind wheel 14 and bevel edger wheel 16 (best shown in FIG. 3) which are situated in the lens edging portion of the machine generally indicated at 18. Bevel edger machines typically include a lens holding system generally indicated at 20 and a lens edge forming assembly generally indicated at 22. The lens holding assembly typically includes lens drive spindles 24 and 26 which grip a lens by way of lens blocks 28 and 32. Typically blocking pads as are known in the art, grip lens 34 for holding a lens during rough grinding and bevel edging of the wheel.

The lens former assembly 22 typically includes a lens shape template 36 which is a specific shape for a particular frame. The template 36 is rotationally coupled with shaft 24 such that as the template member turns, the lens 34 also turns. The lens grinding assembly is pivotable along an axis generally indicated at 38 such that as the lens rotates while it is engaging the grinding wheel 14, the lens former member actuates the lens up and down by interaction between the template 36 and the former member upon which it rests. Such former members are referred to by various names in the art, such as former wheel, copy wheel, wear plates former shoes or former plates. For purposes herein former member shall mean the member upon which the template rides.

Figure 6:
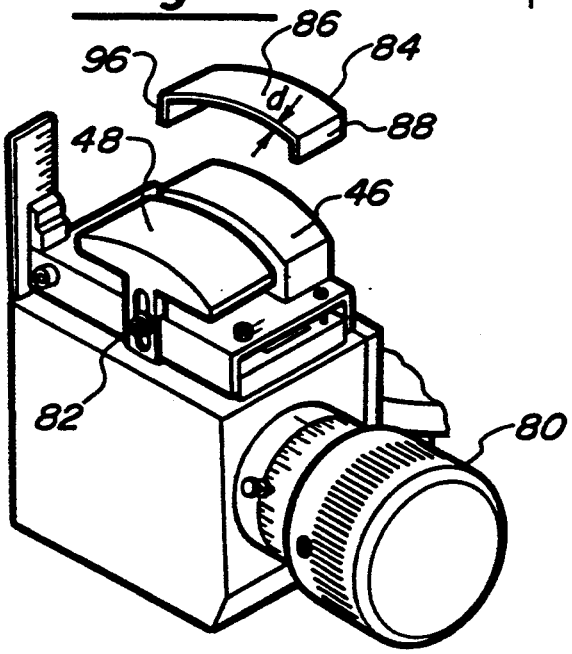
FIG. 6 shows an alternative embodiment.

In an embodiment shown in FIG. 1, a former wheel 40 is utilized in accordance with the present invention which includes a first diameter portion 42 and a second diameter portion 44 on which the template 36 would rest during grinding operations. Shown in FIG. 6 is an alternate embodiment wherein a former shoe is utilized such that the template 36 will interact with shoe 46 or 48 thereby carving out the proper shape of a lens to fit in a particular frame. In known prior art machines the former wheel is a single diameter wheel which the template member 36 rides upon.

Figure 5:
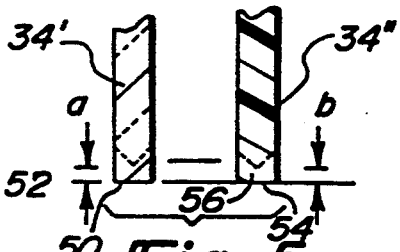
FIG. 5 shows the concept of lens differential.

Referring now in particular to FIG. 5, the concept of differential is explained in more detail. As shown in FIG. 5, the differential is the difference between the rough cut of the outer periphery 50 of the lens 34' and the outside of the bevel edge cut 52 of the lens which is shown as the distance 'a'. Lens 34' is a glass lens and typically as stated above this differential is from 1.5 to 2 millimeters whereas the differential 'b' distance for plastic lens 34'' between the rough grind periphery 54 and the outside of the bevel edge 56 is approximately ½ to 1 millimeter. The difference in these differential numbers is due to the fragile nature of glass wherein during rough grinding more chips are taken off farther into the lens surface. When grinding a plastic lens 34'' the chipped surface does not progress as far into the lens body and therefore lens of a differential between rough grind and final bevel edging is necessary.

The differential for a particular material is typically set internally in the bevel edger machine by a complex set of internal adjustments as are known to those skilled in the art. Thus, the particular differential for the lens material must be in essence "pre-programmed" into the machine for a particular material to be used over and over again. This causes problems when a customer requires a different type of lens material which has a differential other than that programmed into the machine. In accordance with the teachings of the present invention different materials may be accommodated by compensating for this differential externally through one of the embodiments shown and described herein.

Figure 3:
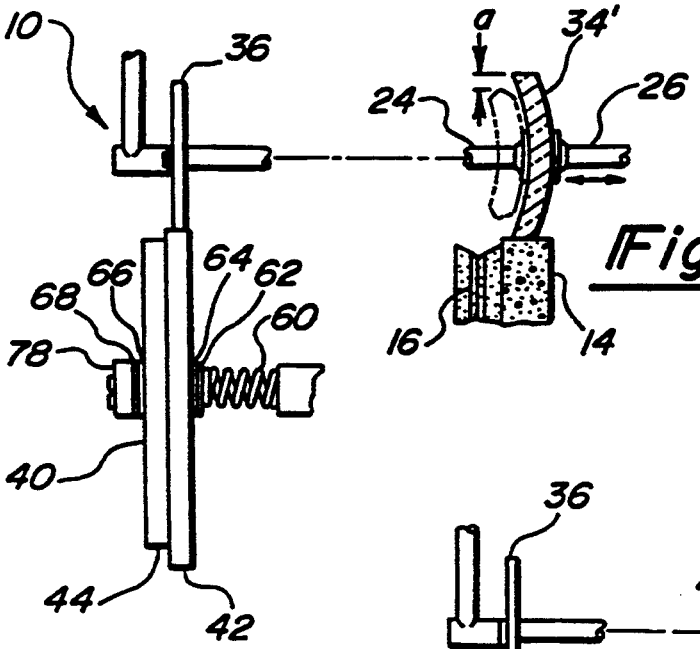
FIG. 3 shows the grinding wheel and former wheel follower assembly.
Figure 4:
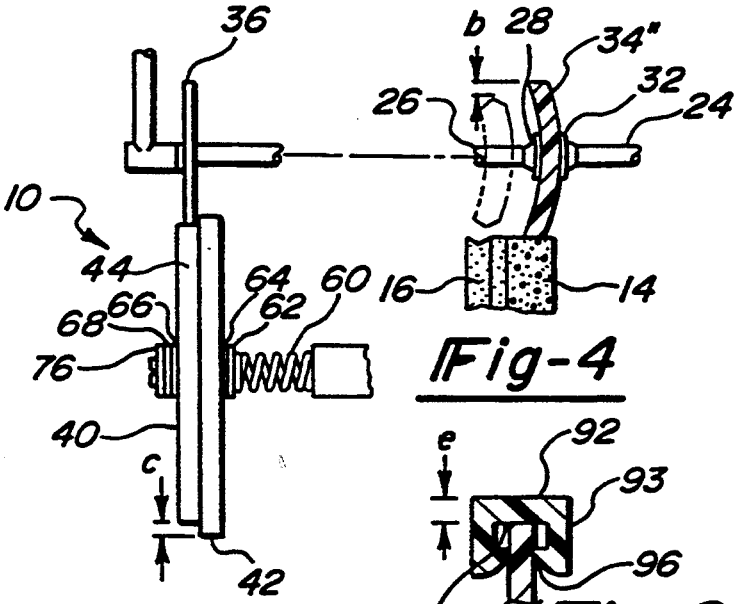
FIG. 4 shows the invention adapted to grind a plastic lens.

Thus, in a first embodiment of the apparatus of the present invention the lens former wheel may be provided such that the outer peripheral surface of portions 42 and 44 are approximately ½ to 1 millimeter in radial distance. When a glass lens is being formed the portion 42 having the larger diameter 'd' is utilized to provide a 1.5 to 2 millimeter differential, as shown in FIG. 3. Whereas when the template member 36 is resting on the portion 44 a lesser differential suitable to accommodate plastic may be utilized for providing the proper differential for plastic materials as shown in FIG. 4.

Figure 2:
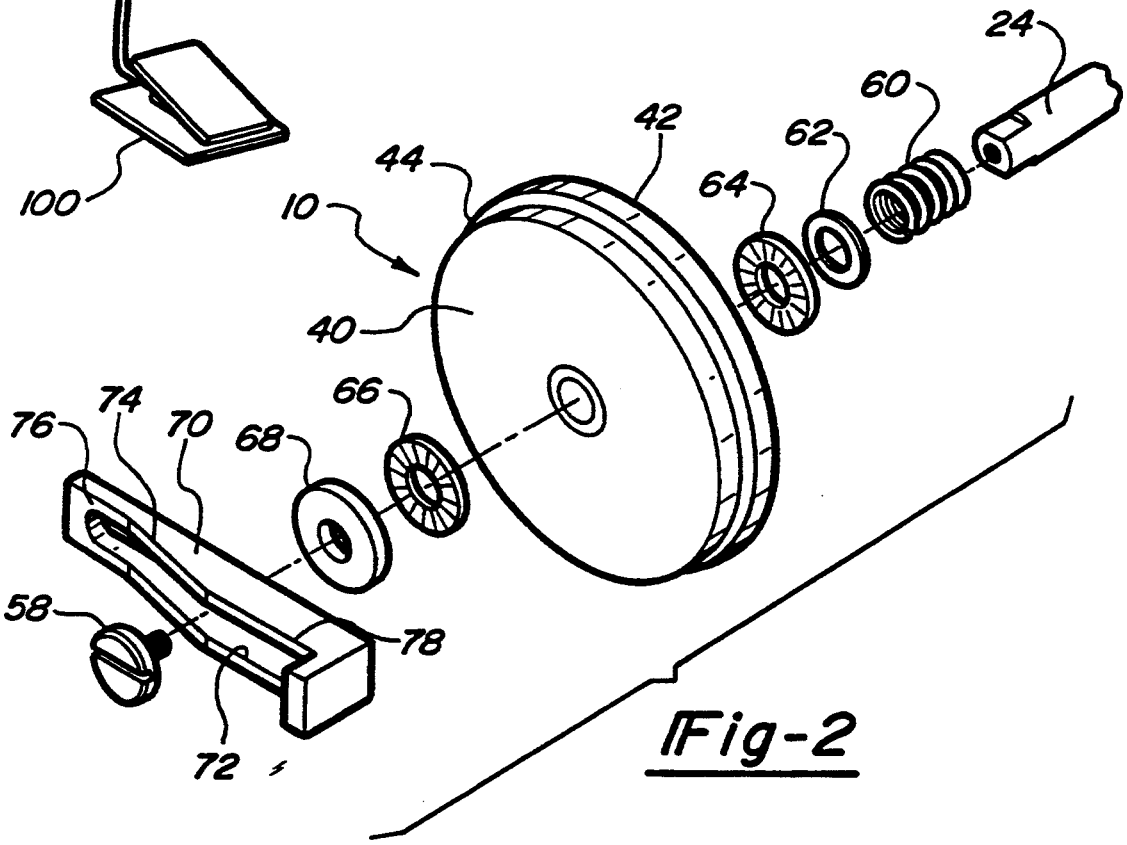
FIG. 2 shows the former wheel of the present invention.

Referring now to FIG. 2, the former wheel assembly of the present invention includes a wheel portion 40 which is rotatably mounted on the shaft 24 and secured thereon via a screw or fastening member 58. On the in-board portion a helical spring biasing member 60 is placed on the shaft and the wheel 40 freely rotates on the shaft and is movable in an axial direction which movement is biased towards the outboard axial direction. The washers 62, 64, 66 and 68 are to provide bushing surfaces so that the wheel 40 is not deformed during actuation of the wheel in an axial direction. An actuating member 70 is provided for actuating the former wheel 40 in an axial direction. Actuating member 70 includes a central slot portion 72, a ramp portion 74 and a first resting surface 76 and a second resting surface 78. The shaft 24 runs through the slot 72. The member 70 is slidable along slot 72 in a direction transverse to the axis of shaft 24 such that the wheel former member 40 is actuated axially from a first position as shown in FIG. 4, wherein the screw rests on surface 76. By actuating the member 70 along slot 72 interference between screw 58 and ramp surface 74 actuates the wheel member inward 40 until the screw 56 is resting on surface 78 to actuate the former wheel member to the second position as shown in FIG. 3. Thus, by utilization of the assembly of the present invention shown in FIG. 2, the user can easily modify a standard bevel edger machine to readily adapt from a first differential for glass for instance by utilizing surface 42 of the former wheel 40 as shown in FIG. 3, to a second differential for plastic or polycarbonate by utilizing surface 44 of the former wheel 40, such as shown in FIG. 4. Modification is relatively inexpensive and would allow increased capacity for small labs having a single bevel edger machine, which accounts for the majority of lens edging laboratories in this country.

Referring now to FIG. 6, there is shown an alternate embodiment of the present invention for a different type of machine which includes differential former shoes 48 and 46. As will be readily appreciated the "pre-programmed" differential in this machine may be adjusted by means of the knob 80 or by means of the set screw adjustment 82 wherein the lens may be first rough ground on the shoe 46 and then bevel edged on the shoe 48 by means of a similar template and axis assembly as set forth above. As will be readily appreciated to those skilled in the art the members 46 and 48 are static and do not move in response to rotation of the template 36, however, they have smooth surfaces such that the pivoting of the lens is accommodated in a similar manner as the afore disclosed machine, i.e. by interaction of the template engaging the former shoes as the lens drive shaft rotates. In this embodiment a shim means 84 is provided which includes on arcuate a surface conforming portion 86 and flanges 88 and 90 which act as end securement portions. The shim 84 has a thickness 'd' which is equal to the necessary adjusted differential between a plastic and a glass for instance which would be approximately 0.5 to 1 millimeter. Thus, by adjusting the dimension 'd' a glass lens can be produced by merely dropping the shim 84 onto the shoe 46 to provide the increased differential necessary to edge a glass lens when such is desired.

Figure 7:
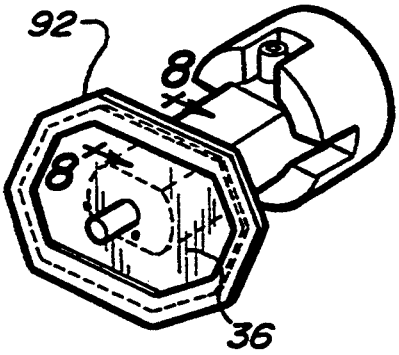

Referring now to FIG. 7 in a still alternate embodiment of the present invention a shim member 92 may be provided wherein a differential for instance such as distance 'e' is placed on the outer periphery of the template 36. This shim 92 is made out of a flexible plastic material which is U-shaped in cross-section and has a consistent width outer wall 93 of the dimension 'e' equal to the 0.5 to 1 millimeter required for a glass lens differential. The member 92 includes a U-shaped channel 94 and is made of a flexible polymer material for instance which is placed around the periphery of the template member 36. Thus, when a glass lens is being ground an increased differential between the roughing stage and the finished bevel edge stage is provided external of the machine. The shim member 92 may include securement lips 96 extending inward for gripping of the template 36.

Thus, in accordance with the teachings of the present invention the differential adjustment can be accomplished on readily available bevel edger machines. Thus, by making a dimension adjustment at the place of contact between the lens template and the former member the necessary adjustment in differential can be accomplished. Utilizing the above teachings it will be readily appreciated that a shim member would also be useable on a standard former wheel to accomplish differential adjustment. Similarly, a stepped forming shoe could be utilized to accomplish the rough grind differential in machines of that type.

In accordance with another aspect of the present invention a process for providing a polished edge on a polycarbonate lens is provided in accordance with this process. Typically, when edging glass and CR 39 type lenses a coolant or lubricant (typically water) is utilized during the grinding process. Polycarbonate on the other hand requires dry grinding of the lens blank. This is because of the thermoplastic nature of the polycarbonate, which will flare in its thickness at the grinding edge if coolant or lubricant is utilized during removal of material. Typically, polycarbonates are dry ground and thereafter polished at their edges on a separate machine. However, the inventor herein has discovered that by operation of an extra final edging cycle, while utilizing coolant, the edge of the lens is polished to meet all necessary standards.

Thus, in accordance with the process aspects of this invention, a cut-off switch 100 or the like is first wired to the pump (generally indicated at 102) or the pump is otherwise disengaged from operation. Thereafter, the polycarbonate lens blank is rough ground and bevel edged without lubricant. After the bevel edge is complete the coolant flow is resumed and the machine is allowed to bevel edge cycle for one full revolution of the lens. This final step accomplishes a final polishing of the lens edge which is as good or better than that achieved on a separate polishing machine.

A foot switch is preferred for the pump power cut-off. Since the coolant pump of bevel edger machine is typically connected separately to the wall socket, an in-line cut-off switch wherein the plug of the pump may be connected to the switching plug of the foot switch is utilized. This is then connected to a suitable outlet. Thus, an operator can step on the foot switch to cut coolant flow when grinding the polycarbonate lens and release the foot switch for allowing coolant flow for final polishing of the lens. This process provides an operator with a polycarbonate lens edging machine via simple modification of the machine. Thus, by utilizing the novel teachings herein a single machine can be utilized to edge all of the lens blank materials common today.

While the above description constitutes the preferred embodiments of the present invention it is to be appreciated that the invention can be practiced in ways other than that specifically disclosed without deviating from the scope or the fair meaning of the present invention as set forth in the accompanying claims.

What is claimed is:

1. A method for accommodating for differential in an ophthalmic lens grinding operation utilizing a bevel edger machine including a lens former assembly comprising the steps of:

a) adapting said lens former assembly by providing a means for adjusting a physical dimension of a portion of said lens former assembly to provide a first profile for increasing the differential profile of the lens former assembly for a first lens blank material and allowing for providing a second differential for the lens former assembly for providing a proper differential for a second lens blank material;

b) whereby bevel edging of a plurality of lens blank materials requiring different differentials can be accomplished without internal adjustment of the bevel edging machine.

2. The process according to claim 1 wherein said lens former assembly further comprises a template member and a forming member further comprising the step of providing a means for increasing the said forming member or said pattern member's physical dimension to provide a predetermined corresponding dimensional change in the differential between the rough cut of a lens and the bevel edging cut of the lens.

3. In a bevel edger machine including a rough cut wheel, a finishing wheel and a former apparatus for following a lens template for edge forming of a lens, an apparatus for externally setting a differential for said bevel edger machine, comprising a means external to the machine differential settings for adjusting a physical dimension of the lens former apparatus for providing a first profile for increasing the differential profile of the lens former apparatus for a first lens blank material and adjustable to a second profile to provide a second predetermined differential.

4. A method for accommodating for differential in an ophthalmic lens grinding operation utilizing a bevel edger machine including a lens former assembly comprising: adapting said lens former assembly to provide a first profile for increasing the differential profile of the lens former assembly for a first lens blank material and allowing for providing a second differential for the lens former assembly for providing a proper differential for a second lens blank material, said former assembly comprising a forming member and a template member and wherein a shim means is used to increase a physical dimension of the forming member for providing the proper differential whereby bevel edging of a plurality of lens blank materials requiring different differentials can be accomplished without internal adjustment of the bevel edging machine.

5. The method of claim 4 wherein said shim means is used to increase the dimension of said template member.

6. A method for accommodating for differential in an ophthalmic lens grinding operation utilizing a bevel edger machine including a lens former assembly comprising adapting said lens former assembly to provide a first profile for increasing the differential profile of the lens former assembly for a first lens blank material and allowing for providing a second differential for the lens former assembly for providing a proper differential for a second lens blank material, said former assembly comprising a forming wheel and a template member which engages said former wheel, said former wheel having a first forming surface of a first diameter for providing said first differential and a second diameter for providing said second differential.

7. The process of claim 6 further comprising the step of manually actuating said former wheel to the desired differential setting.

8. In a bevel edger machine including a rough cut wheel, a finishing wheel and a former apparatus for following a lens template for edge forming of a lens, an apparatus for externally setting a differential for said bevel edger machine, comprising a means external to the machine differential settings for adjusting a dimension of the lens former apparatus for providing a first profile for increasing the differential profile of the lens former apparatus for a first lens blank material and adjustable to a second profile to provide a second predetermined differential, said means further comprising a wheel former member including a first portion having a first diameter and a second portion having a second diameter, said wheel former member being actuatable to a first position wherein said lens template engages said first portion and to a second position wherein said lens template engages said second surface whereby either a first differential or a second differential depending on a lens blank material being used.

9. The apparatus of claim 8 wherein said first diameter and said second diameter have a dimension difference of 1 millimeter for providing the proper differential for grinding of glass and plastic lens blanks.

10. The apparatus of claim 8 further comprising a shaft portion for attachment to said bevel edger machine, said wheel former member being slideable axially along said shaft and biased toward movement in a direction along the shaft, and actuation means for slideably actuating said wheel former member from said first position to said second position.

11. The apparatus of claim 10 wherein said actuation means further comprises a ramp means for forcing said former wheel in an axial direction.

12. The apparatus of claim 10 wherein said actuation means further comprises an elongate ramp actuation member and said shaft further includes an end stop abutment, said ramp actuation member including surfaces forming an elongated slot therein for receiving said shaft, and also including a ramped portion and a locking portion, said actuator being slideable in a direction perpendicular to the shaft axis from said first position to said second position whereby said ramp surface actuates said wheel former member in an axial direction along said shaft and may be thereafter held in said second position by said locking surface.

13. In a bevel edger machine including a rough cut wheel, a finishing wheel and a former apparatus for following a lens template for edge forming of a lens, an apparatus for externally setting a differential for said bevel edger machine, comprising a means external to the machine differential settings for adjusting a dimension of the lens former apparatus for providing a first profile for increasing the differential profile of the lens former apparatus for a first lens blank material and adjustable to a second profile to provide a second predetermined differential, said former apparatus further comprises a former shoe and said means further comprises a shim member for removable placement between said former shoe and said template thereby externally adjusting said differential profile.

14. In a bevel edger machine including a rough cut wheel, a finishing wheel and a former apparatus for following a lens template for edge forming of a lens, an apparatus for externally setting a differential for said bevel edger machine, comprising a spacer member for placement about the periphency of said template for adjusting a dimension of the lens former apparatus for providing a first profile for increasing the differential profile of the lens former apparatus for a first lens blank material and adjustable to a second profile to provide a second predetermined differential.

15. The apparatus of claim 14 wherein said spacer member further comprises a flexible strip for securement about the peripheral edge of said lens template.

16. The apparatus of claim 15 wherein said flexible strip further comprises an elongate member having a 'U' shaped cross-section for forming a channel, said channel engaging an edge of the lens template, said elongate member having a predetermined thickness for increasing an outside dimension of said template to provide for the differential for a second material.

* * * * *

UNITED STATES PATENT AND TRADEMARK OFFICE

CERTIFICATE OF CORRECTION

PATENT NO. : 5,384,987

DATED : January 31, 1995

INVENTOR(S) : Ronald C. Wiand

It is certified that error appears in the above-indentified patent and that said Letters Patent is hereby corrected as shown below:

Column 2, Line 59, "FIG. 1 shows a typical bevel edger machine;

FIG. 2 shows the former wheel of the present invention;

FIG. 3 shows the grinding wheel and former wheel follower assembly;

FIG. 4 shows the invention adapted to grind a plastic lens;

FIG. 5 shows the concept of lens differential;

FIG. 6 shows an alternative embodiment; and

Figure 8:
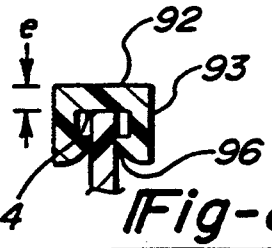
FIGS. 7 and 8 show another embodiment.

FIG. 7 and 8 show another embodiment." should be --Figure 1 is a perspective view of a bevel edger machine incorporating a first embodiment of the present invention;

Figure 2 is an exploded view of a first embodiment of the present invention;

Figure 3 is a detailed plan view (partially broken away) illustrating the present invention in a first operational configuration for use with a glass lens;

Figure 4 is a detailed plan view (partially broken away) illustrating the present invention is a second operational configuration for use with a plastic lens;

Figure 5 is a sectional view plan (partially broken away) illustrating the differential variations between glass lens and a plastic lens;

Figure 6 is a perspective view of an alternate embodiment of the present invention;

UNITED STATES PATENT AND TRADEMARK OFFICE

CERTIFICATE OF CORRECTION

PATENT NO. : 5,384,987

DATED : January 31, 1995

INVENTOR(S) : Ronald C. Wiand

It is certified that error appears in the above-indentified patent and that said Letters Patent is hereby corrected as shown below:

Figure 7 is a perspective view illustrating an alternate embodiment of the present invention; and Figure 8 is a sectional view taken along line 8-8 of Figure 7.--.

Signed and Sealed this

Thirtieth Day of April, 1996

*Attest:*

Bruce Lehman

BRUCE LEHMAN

*Attesting Officer*

*Commissioner of Patents and Trademarks*